US005960942A

United States Patent [19]

Thornton

[11] Patent Number: 5,960,942

[45] Date of Patent: Oct. 5, 1999

[54] THIN PROFILE KEYPAD WITH INTEGRATED LEDS

[75] Inventor: Curtis W. Thornton, Cary, N.C.

[73] Assignee: Ericsson, Inc., Research Triangle Park, N.C.

[21] Appl. No.: 09/112,178

[22] Filed: Jul. 8, 1998

[51] Int. Cl.[6] ..... H01H 9/18

[52] U.S. Cl. ..... 200/314; 362/85; 362/800

[58] Field of Search ..... 200/314, 5 A; 362/24, 29, 30, 85, 800

[56] References Cited

U.S. PATENT DOCUMENTS

| | | | |
|---|---|---|---|
| 4,385,213 | 5/1983 | Larson | 200/5 A |
| 4,975,814 | 12/1990 | Schairer | 362/800 |
| 5,097,396 | 3/1992 | Myers | 362/29 X |
| 5,149,923 | 9/1992 | Demeo | 200/314 X |
| 5,847,336 | 12/1998 | Thornton | 200/5 A |

*Primary Examiner*—Renee S. Luebke
*Attorney, Agent, or Firm*—Coats & Bennett, P.L.L.C.

[57] ABSTRACT

A backlit keypad assembly includes a flexible film having a bottom surface having electrical circuits, typically referred to as flex circuits, thereon and a top surface having at least one, and preferably a plurality of keys defined thereon. Each backlit key includes a cavity on the underside thereof. In each cavity is a light emitting diode, preferably of bottom emitting type, attached to the flexible film and connected to the electrical circuits and a filler material which at least partially surrounds the light emitting diode. Associated with each key is a push-type switch below and in respective aligned relationship with the light emitting diodes which senses when the corresponding key is pressed down by a user. The light emitting diodes emit light directly through the flexible film without intervening layers such as light guides, thereby allowing the overall lighted keypad assembly to be thinner than with previous approaches. Such a keypad may be fabricated by directly attaching a plurality of bottom emitting light emitting diodes to the bottom side of the flexible film and connecting the light emitting diodes to the electrical circuits. Thereafter, the flexible film is vacuum formed so as to form a plurality of depressible keys on the top surface thereof and a corresponding plurality of cavities on the bottom surface thereof containing therein the light emitting diodes. The process continues by thereafter substantially filling the remainder of the cavities with a filler material which hardens upon curing and adheres to the bottom surface of the flexible film so as to form a flexible pad. The flexible pad is then typically placed in intimate contact with the printed circuit board and preferably mated thereto.

23 Claims, 5 Drawing Sheets

THIN PROFILE KEYPAD WITH INTEGRATED LEDS

FIELD OF THE INVENTION

The present invention relates generally to a keypad assembly and more particularly to a keypad assembly in which each key is separately illuminated by a light source positioned directly under each key.

BACKGROUND OF THE INVENTION

Most cellular phones and other telecommunications and key-operated instruments use backlighting of their keypads to enable the user to view the identity and position of the keys in low or no ambient light conditions.

Typically, light-emitting diodes (LEDs) are mounted on a printed circuit board (PCB) and transmit light in an indirect manner to the keys of the keypad, such as via an underlying light guide or via individual fiber optics as disclosed in U.S. Pat. No. 5,097,396 issued Mar. 17, 1992 to J. Michael Myers. Alternatively, electro-luminescent panels are used to provide backlighting. However, the present methods are inefficient when considering the total power used with respect to the light output through the individual keys. Light may be lost through intermediate transmission, such as the light guide or optical fibers, through filters or attenuating layers, or overly broad areas of illumination. In addition, the present methods consume significant space.

With the push to smaller and smaller key-operated instruments and the need for longer and longer battery life, there remains a need for thin profile backlit keypads which use generated illumination efficiently. Such a backlit keypad assembly should direct virtually all of the light emitted by an LED to the corresponding key without light guides, fiber optic elements, or intermediate layers between the LED and the corresponding key.

SUMMARY OF THE INVENTION

The present invention uses a vacuum formed flex circuit to create a thinner backlit keypad assembly. The backlit keypad assembly includes a flexible film having a top surface and a bottom surface and preferably formed of an electrically nonconductive, translucent, elastomeric material. The bottom surface includes electrical circuits thereon, typically referred to as flex circuits. The top surface has at least one, and preferably a plurality of keys defined thereon and preferably includes graphics to differentiate the keys. For purposes of illustration, it will be assumed that there are a plurality of keys. Each backlit key includes a cavity on the underside thereof. In each cavity is a light emitting diode, preferably of bottom emitting type, attached to the flexible film and connected to the electrical circuits and a filler material which at least partially surrounds the light emitting diode. Associated with each key is a push-type switch, preferably having a raised dome with an electrically conductive element disposed on a lower surface thereof for sensing when the corresponding key is pressed down by a user. The switches are below and in respective aligned relationship with the light emitting diodes. At least a portion of a printed circuit board with contacts thereon is disposed beneath the flexible film so that the contacts are in a respective aligned relationship with the switches. The conductive element of a switch makes electrical contact with corresponding contacts on the printed circuit board when the corresponding key is pressed down by a user and the collapsible dome provides tactile feedback to the user. The light emitting diodes emit light directly through the flexible film without intervening layers such as light guides, thereby allowing the overall lighted keypad assembly to be thinner than with previous approaches.

Optionally, the keypad assembly further includes a flexible sheet disposed at least partially between the flexible film and the printed circuit board; this flexible sheet may include the switches with or without tactile feedback means. Additionally, the keypad assembly may also optionally include a protective film overlaying the top surface of the flexible film so as to provide greater wear resistance.

A method for fabricating such a backlit keypad assembly includes directly attaching a plurality of bottom emitting light emitting diodes to the bottom side of the flexible film and connecting the light emitting diodes to the electrical circuits. Thereafter, the flexible film is vacuum formed so as to form a plurality of depressible keys on the top surface thereof and a corresponding plurality of cavities on the bottom surface thereof. The cavities containing therein the light emitting diodes. The process continues by thereafter substantially filling the remainder of the cavities with a filler material which hardens upon curing and adheres to the bottom surface of the flexible film so as to form a flexible pad. The flexible pad is then typically placed in intimate contact with the printed circuit board and preferably mated thereto. Optionally, the method may includes printing graphics on the top surface of the flexible film prior to vacuum forming and/or placing a protective film in intimate contact with the top surface of the flexible film prior to vacuum forming.

DETAILED DESCRIPTION

Figure 1:
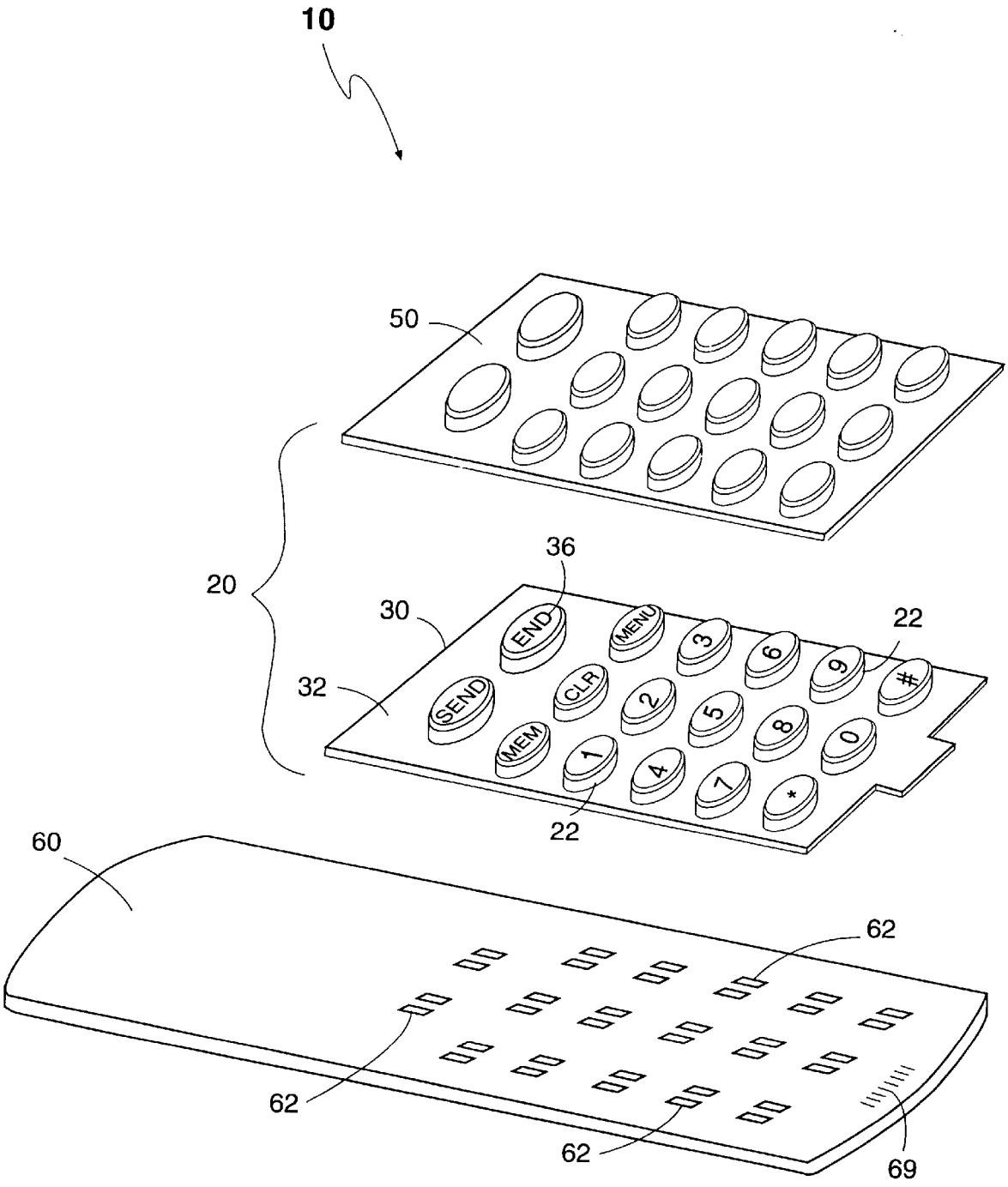
FIG. 1 is a partially exploded perspective view of a keypad assembly of the present invention.

The keypad assembly 10 of the present invention includes a flexible pad 20 coupled to a printed circuit board (PCB 60) and optionally a flexible sheet 80 having switches 84 thereon. The flexible pad 20 has defined thereon at least one, and preferably a plurality of separately actuatable keys 22 arranged in a predefined pattern on the flexible pad 20. For purposes of illustration, a plurality of keys 22 will be used, but the present invention also encompasses keypads 10 having only one key 22 thereon. The flexible pad 20 includes a flexible film 30, a plurality of light-emitting diodes (LEDs) 40 mounted on the flexible film 30, and an optional transparent protective film 50. Underlying at least a portion of the flexible pad 20 is the printed circuit board (PCB) 60.

The flexible film 30 extends over the keypad area and may optionally extend to other areas of the key-operated instrument. In the area of the keypad, the flexible film 30 is made from a flexible material that is preferably electrically nonconductive, transparent, and elastomeric. Examples of suitable materials include polycarbonates and polyesters. The flexible film 30 has graphics 36, such as indicia of telephone or function keys, or the like, printed on its top side 32 and electrical circuits 38, typically known as flex circuits, on at least its bottom side 34. The electrical circuits 38 interconnect a plurality of LEDs 40 with a connector 39 on the flexible film 30 and allow individual or group activation of the LEDs 40. The LEDs 40 are bottom emitting type and are attached to the electrical circuits 38 via any means well known in the industry, such as by the use of conductive epoxy 42. The position of the LEDs 40 correspond with the position of the keys 22 on the keypad 10.

Thereafter, the flexible film 30, with the LEDs 40 attached, is vacuum formed, creating a generally flat plane with raised areas (keys) 22 having cavities 24 underneath in the location of each key 22. The vacuum forming process should take place at a temperature near the heat deflection temperature of the particular material chosen for the flexible film 30. Due to the stretching or other distortion induced in the flexible film by the vacuum forming process, it may be desirable to add additional material to the electrical circuits 38, such as additional thickness or additional width, to accommodate the change in shape required to form the keys 22.

Optionally, a thin transparent protective film 50 may be fused to the flexible film 30 during, or prior to, the vacuum forming process. The purpose of the protective film 50 is to provide additional wear resistance so as to prolong the life of the graphics 36. Alternatively, the flexible film 30 may be sprayed with a protective coating.

The cavities 24 on the underside 34 of the flexible film 30 are partially filled by the LEDs 40. The remainder of each cavity 34 is substantially filled by a filler material 70 to a level even with or slightly less than the level of the back plane of the flexible film 30. The filler material 70 then cures to a hardened condition. Examples of suitable filler materials 70 include polycarbonates or acrylonitrile butadiene styrene. Once the filler material 70 has hardened, the flexible pad 20 is ready for joining to the PCB 60.

Figure 5:
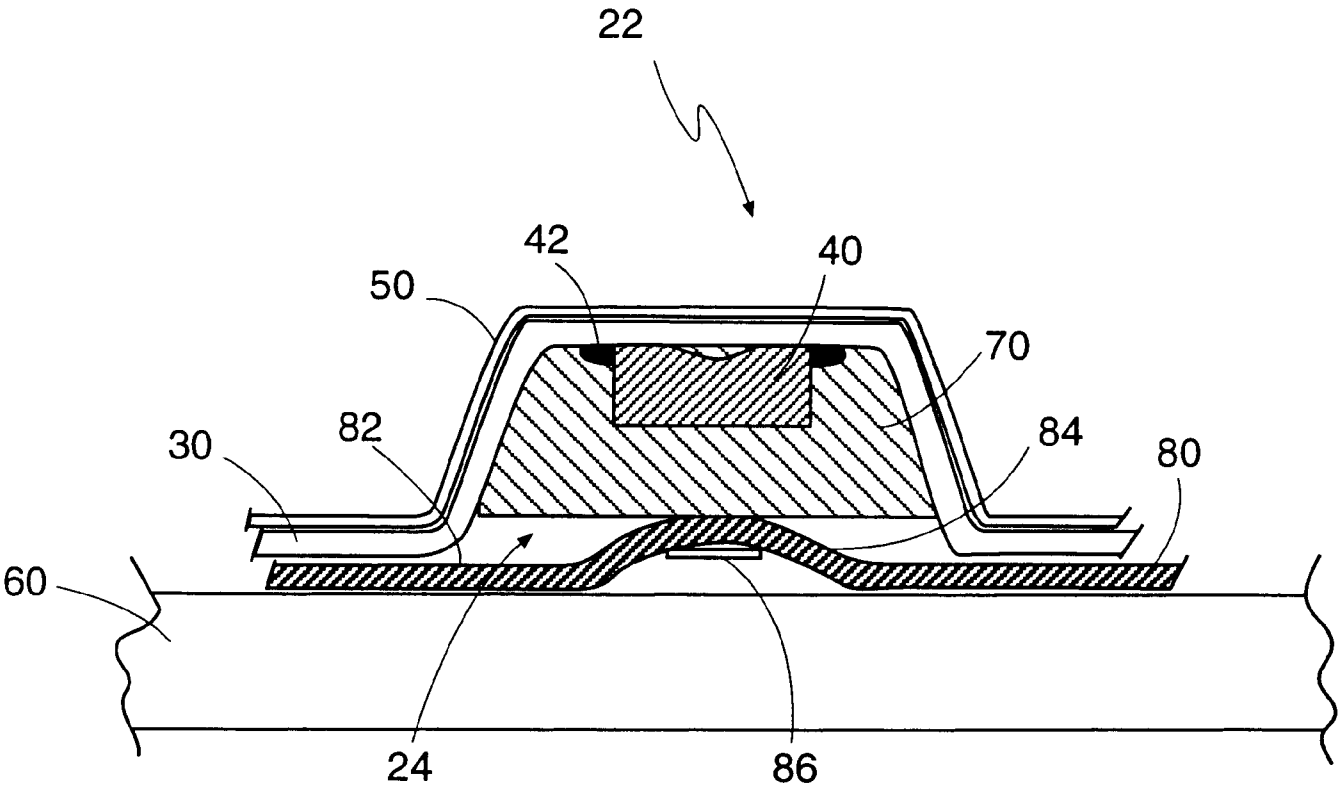
FIG. 5 is partial cross sectional view of the keypad assembly of FIG. 2 showing one typical key cross section.

In one preferred embodiment, the keypad assembly 10 also includes a flexible sheet 80 formed of a plastic material, such as polyester teraphthalate, which has an upper surface 82 disposed in adjacent relationship with the lower surface 34 of the flexible film 30. The flexible sheet 80 has a plurality of push-type switches 84, such as collapsible raised domes integrally formed therein. Each of the collapsible raised domes 84 is aligned with a respective one of the keys 22 of the flexible film 30. The domes 84 provide a tactile feedback to a user to indicate positive displacement of the dome 84 when the key 22 is fully pressed. As best shown in FIG. 5, each of the collapsible raised domes 84 formed on the flexible sheet 80 has an electrically conductive element 86 disposed on the underneath, concave surface thereof in a spaced apart, aligned relationship with the corresponding electrical contacts 62 provided on the PCB 60. Other examples of push-type switches 84 include conventional push-button switches and similar switches that can be operated by finger pressure on the key 22 associated with the switch 84.

The PCB 60 has at least one, and preferably, a plurality of electrical contacts 62 disposed on an upper surface of the PCB 60. In addition, the PCB 60 typically includes additional circuitry of a type well known in the art for determining when a specific set of the electrical contacts 62 have been bridged, indicating the pressing of a key 22, and for other operations of the key-operated instrument. The electrical contacts 62 are arranged in a predefined pattern wherein a pair of the electrical contacts 62 are aligned with a respective one of the keys 22 of the flexible film 30 when the keypad assembly 10 is joined together. The PCB 60 also has a plurality of electrical connectors 69 disposed at one end that are arranged to mate with the respective electrical connectors 39 disposed on the flexible film 30 and through which electrical power is provided to the LEDs 40 mounted on the flexible film 30. The electrical connectors 39 on the flexible film 30 and the electrical connectors 69 disposed at the end of the PCB 60 are electrically connected, preferably by a conductive adhesive capable of being melted in the presence of heat such that provided by hot bar techniques.

Figure 2:
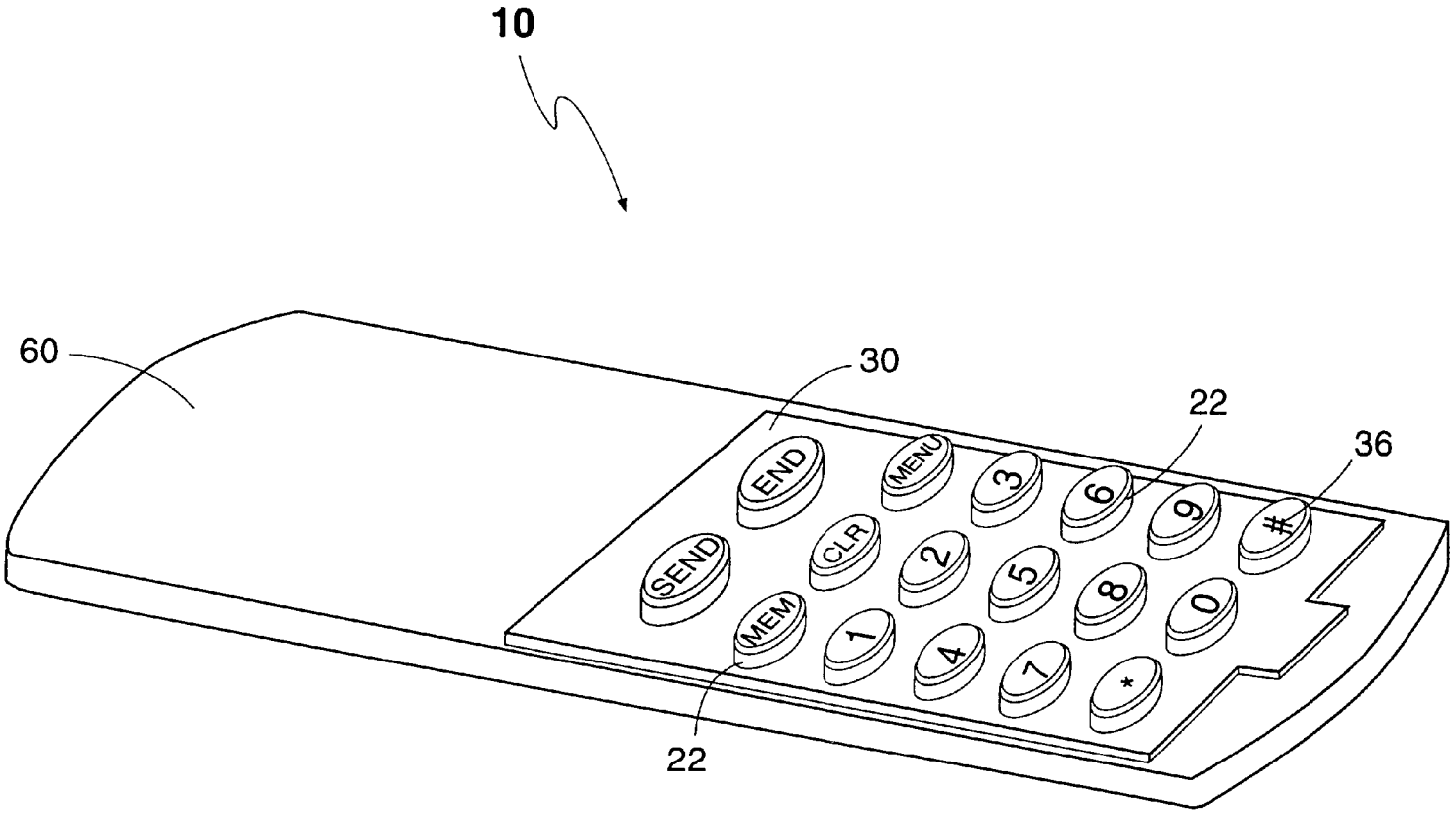
FIG. 2 is an assembled perspective view of the keypad assembly shown in FIG. 1.
Figure 3:
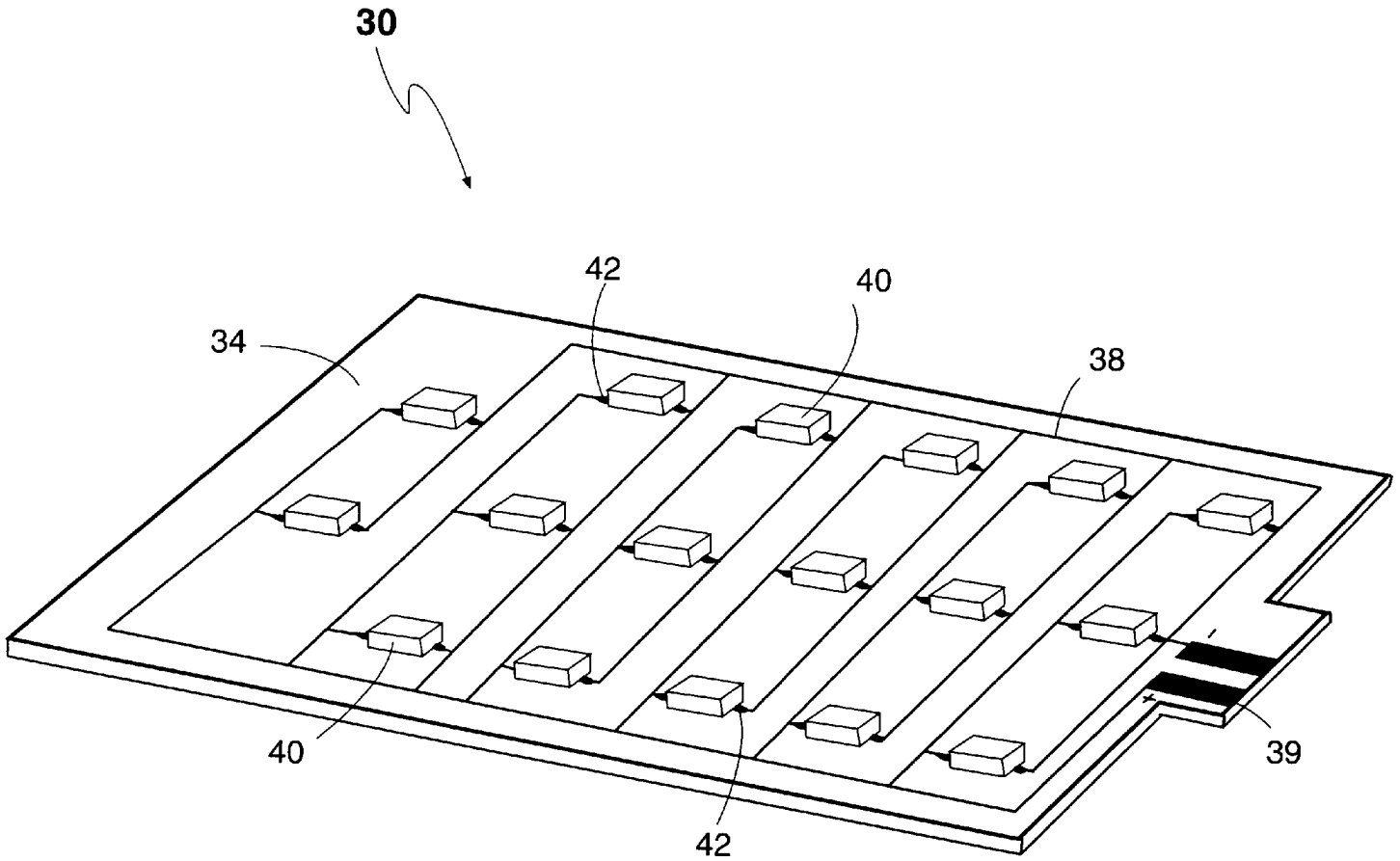
FIG. 3 is bottom perspective view of a flexible film of the present invention prior to vacuum forming, showing the light emitting diodes.
Figure 4:
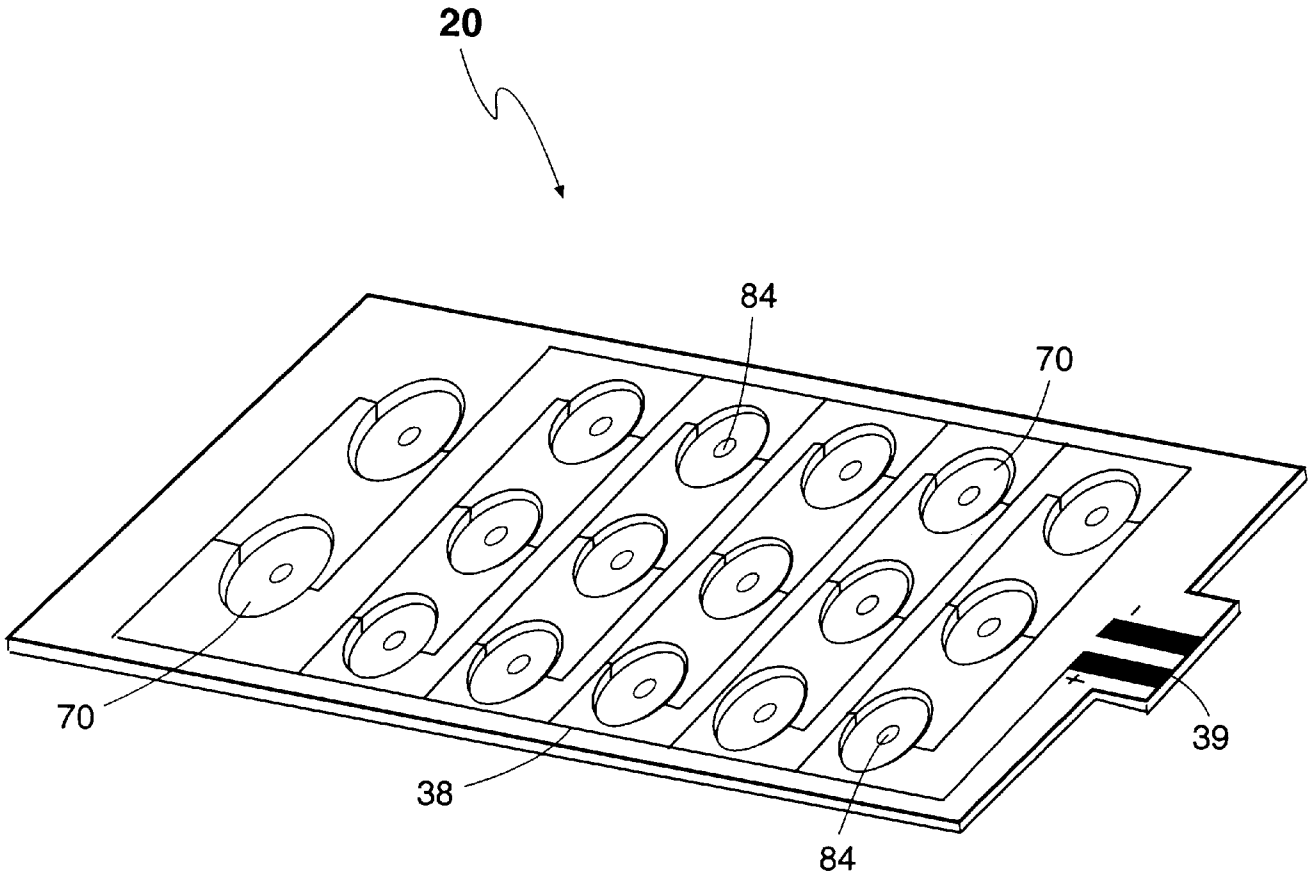
FIG. 4 is bottom perspective view of a flexible film of the present invention after vacuum forming and filling of the key cavities, showing the electrically conductive elements.

The flexible pad 20 may be mated to the PCB 60 by adhesively joining the lower surface 34 of the flexible film 30 to the upper surface of the PCB 60, with the flexible sheet 80 sandwiched in-between if necessary, providing an assembly as shown in FIG. 2. Alternatively, the flexible pad 20, and the flexible sheet 80 if used, may be aligned with the PCB 60 inside a housing or bezel which provides respective alignment of the components.

The key-press operation of the keypad assembly 10 is best seen with reference to the cross-sectional view of FIG. 5. When a selected key 22 is depressed, the pressing force is transmitted through the optional protective film 50, to the flexible film 30, through the hard filler 70, to the respective underlying raised dome 84 on the flexible sheet 80, causing the dome 84 to be deflected downwardly to a collapsed position. This action causes the electrically conductive element 86 on the underneath surface of the dome 84 to bridge the corresponding pair of electrical contacts 62 on the PCB 60, thereby completing an electrical circuit indicative of the position of the depressed key 22.

The individual keys 22 are illuminated by the light emitted from the "bottom" of the LEDs 40 which is emitted upwardly due to the orientation of the LEDs 40. The light emitted travels through the flexible film 30, and through the transparent protective film 50 if present. Because the flexible film 30 defines the exterior of the key 22, the light from the LED 40 is transmitted directly to the key 22 without going through intervening layers or filters. Further, because LEDs 40 require less circuitry than electro-luminescent panels, the keypad assembly 10 may be simpler and cheaper to use. Lastly, because no extra layers are employed, such as light guides, the overall lighted keypad assembly 10 may be thinner than with previous approaches.

The discussion above includes a flexible sheet 80 containing switches 84 integrally formed with the sheet 80. However, this arrangement is not necessary. Instead, the switches 84 may be attached directly to, or be formed as part of, the filler 70 for each key 22. That is, the function of the flexible sheet 80 may be integrated into the filler 70, thereby creating a thinner overall profile.

The present invention may, of course, be carried out in other specific ways than those herein set forth without departing from the spirit and essential characteristics of the invention. The present embodiments are, therefore, to be considered in all respects as illustrative and not restrictive, and all changes coming within the meaning and equivalency range of the appended claims are intended to be embraced therein.

What is claimed is:

1. A keypad assembly, comprising:

a) a flexible film having a top surface with at least one key defined thereon and a bottom surface; said bottom surface having electrical circuits thereon;

b) at least one light emitting diode attached to said bottom surface and connected to said electrical circuits; said light emitting diode in respective aligned relationship with one of said at least one key of said flexible film;

c) a filler material disposed at least partially below said light emitting diode;

d) at least one push-type switch below said flexible film and in a respective aligned relationship with said light emitting diode; and e) wherein said light emitting diode emits light directly through said flexible film and wherein said switch senses when the corresponding key is pressed down by a user.

2. The keypad assembly of claim 1 further including a printed circuit board having contacts thereon and disposed lower than said flexible film; wherein said contacts are in a respective aligned relationship with said key associated with said light emitting diode.

3. The keypad assembly of claim 2 wherein said switch includes a collapsible raised dome having an electrically conductive element disposed on a lower surface thereof and wherein said conductive element makes electrical contact with said contacts when the corresponding key is pressed down by a user.

4. The keypad assembly of claim 1 further including a flexible sheet and wherein said flexible sheet includes said switch.

5. The keypad assembly of claim 1 wherein said light emitting diode is a bottom emitting light emitting diode.

6. The keypad assembly of claim 1 further including a protective film overlaying said top surface of said flexible film.

7. The keypad assembly of claim 1 wherein said top surface of said flexible film includes graphics thereon.

8. A keypad assembly, comprising:

a) a flexible film having a top surface with a plurality of keys defined thereon and a bottom surface; said bottom surface having electrical circuits thereon; said keys including:

i) a cavity on the underside thereof;

ii) a light emitting diode attached to said bottom surface in said cavity and connected to said electrical circuits; and iii) a filler material disposed in said cavity;

b) a plurality of push-type switches below said flexible film and in respective aligned relationship with said light emitting diodes; and c) wherein at least one of said light emitting diodes emits light directly through said flexible film and wherein at least one of said switches senses when the corresponding key is pressed down by a user.

9. The keypad assembly of claim 8 further including a printed circuit board having contacts thereon and disposed lower than said flexible film; wherein said contacts are in a respective aligned relationship with said keys.

10. The keypad assembly of claim 9 wherein said switches include a collapsible raised dome having an electrically conductive element disposed on a lower surface thereof and wherein said conductive element makes electrical contact with said corresponding contacts on said printed circuit board when the corresponding key is pressed down by a user.

11. The keypad assembly of claim 9 further including a flexible sheet and wherein said flexible sheet includes at least a portion of said switches.

12. The keypad assembly of claim 9 wherein said light emitting diodes are a bottom emitting light emitting diode.

13. The keypad assembly of claim 9 further including a protective film overlaying said top surface of said flexible film.

14. The keypad assembly of claim 9 wherein said top surface of said flexible film includes graphics thereon.

15. A keypad assembly, comprising:

a) a flexible film having a top surface with a plurality of keys defined thereon and a bottom surface; said bottom surface having electrical circuits thereon; said top surface having graphics thereon, said keys including:

i) a cavity on the underside thereof;

ii) a bottom emitting light emitting diode attached to said bottom surface in said cavity and connected to said electrical circuits; and iii) a filler material disposed in said cavity and at least partially surrounding said light emitting diode;

b) a plurality of collapsible raised dome switches having an electrically conductive element disposed on a lower surface thereof, said switches disposed below and in respective aligned relationship with said light emitting diodes;

c) a printed circuit board having contacts thereon and disposed lower than said flexible film; wherein said contacts are in a respective aligned relationship with said switches; and d) wherein said light emitting diodes emit light directly through said flexible film and wherein said conductive element makes electrical contact with corresponding contacts on said printed circuit board when the corresponding key is pressed down by a user.

16. The keypad assembly of claim 15 further including a flexible sheet and wherein said flexible sheet includes at least a portion of said switches.

17. The keypad assembly of claim 15 further including a protective film overlaying said top surface of said flexible film.

18. The keypad assembly of claim 15 wherein said flexible film is at least partially formed of an electrically nonconductive, translucent, elastomeric material.

19. A method for fabricating a keypad assembly, comprising:

a) directly attaching a plurality of bottom emitting light emitting diodes to a flexible film; said flexible film having a bottom surface and a top surface and electrical circuits defined on at least one surface thereof, said light emitting diodes being attached to the bottom surface of said flexible film;

b) connecting said light emitting diodes to said electrical circuits;

c) thereafter vacuum forming said flexible film so as to form a plurality of depressible keys on the top surface thereof and a corresponding plurality of cavities on the bottom surface thereof; said cavities containing therein said light emitting diodes and having a remainder space not occupied by said light emitting diodes; and d) thereafter substantially filling the remainder space of said cavities with a filler material which hardens upon curing and adheres to said bottom surface of said flexible film so as to form a flexible pad.

20. The method of claim 19 further including placing said flexible pad in intimate contact with a printed circuit board having contacts thereon.

21. The method of claim 19 further including printing graphics on the top surface of said flexible film prior to said vacuum forming.

22. The method of claim 19 further including placing a protective film in intimate contact with the top surface of said flexible film prior to said vacuum forming.

23. The keypad assembly of claim 19 wherein said flexible film is at least partially formed of an electrically nonconductive, translucent, elastomeric material.

* * * * *